US006003479A

United States Patent [19]

Evans

[11] Patent Number: 6,003,479

[45] **Date of Patent: *Dec. 21, 1999**

[54] PISTON CONSTRUCTION

[76] Inventor: Mark M. Evans, 67 Welts St., Mt. Clemens, Macomb County, Mich. 48043

[ * ] Notice: This patent issued on a continued prosecution application filed under 37 CFR 1.53(d), and is subject to the twenty year patent term provisions of 35 U.S.C. 154(a)(2).

[21] Appl. No.: 08/854,631

[22] Filed: May 12, 1997

[51] Int. Cl.[6] ..... F01P 3/10

[52] U.S. Cl. ..... 123/41.31; 123/41.35; 92/186

[58] Field of Search ..... 123/41.31, 41.34, 123/41.35, 41.37, 41.42, 41.44, 193.6; 92/186

[56] References Cited

U.S. PATENT DOCUMENTS

| | | | |
|---|---|---|---|
| 2,772,933 | 12/1956 | Nichols | 92/186 |
| 3,189,010 | 6/1965 | Isley | 123/41.35 |
| 3,190,273 | 6/1965 | Bachle et al. | 123/41.35 |
| 3,323,503 | 6/1967 | Grosshans et al. | 123/41.35 |
| 3,545,341 | 12/1970 | Fischer | 92/176 |
| 3,613,521 | 10/1971 | Itano | 92/186 |
| 3,915,141 | 10/1975 | Öttl et al. | 123/193.6 |
| 4,253,430 | 3/1981 | Garter et al. | 123/41.38 |
| 4,270,494 | 6/1981 | Garter et al. | 123/41.35 |
| 4,577,595 | 3/1986 | Deutschmann et al. | 123/41.35 |
| 4,587,932 | 5/1986 | Moebus | 123/41.35 |
| 4,774,926 | 10/1988 | Adams | 123/668 |
| 4,838,149 | 6/1989 | Donnison et al. | 92/222 |
| 5,617,823 | 4/1997 | Gray et al. | 123/254 |

*Primary Examiner*—Noah P. Kamen
*Assistant Examiner*—Hai Huynh
*Attorney, Agent, or Firm*—Peter A. Taucher; David L. Kuhn

[57] ABSTRACT

A piston for a high performance engine has a crown and a skirt integrally formed with the crown. A step is defined about the crown and an annular channel is machined in the step. A ring belt facially encircling the crown sealingly covers the annular channel so as to form an enclosed passageway where the coolant circulates. The piston has passages by which coolant under pressure is sent to the crown. The crown has a coolant entry duct communicating the passages to the annular channel and has a coolant exit duct communicating the annular channel with a cavity in the skirt.

6 Claims, 3 Drawing Sheets

PRIOR ART

PISTON CONSTRUCTION

GOVERNMENT USE

The invention described here may be made, used and licensed by or for the U.S. Government for governmental purposes without paying me any royalty.

BACKGROUND

High output reciprocating engines tend to have limitations caused by extremely high temperature. Consequently, resistance to thermal stress is a key parameter in piston design. Such loading causes excessive piston expansion, distortion, loss of strength, thermal fatigue, cracking and piston seizures. The high temperatures also cause oil decomposition and formation of varnish and coke, so that piston rings stick in their grooves and fail to seal properly against cylinder walls.

Various known designs are used to counter the effects of extremely high engine temperature. Some engines have arrangements to spray lubricating oil on the underside of the piston crowns to cool the pistons. In other engines, especially diesels requiring thicker pistons, oil passages are cored into the crowns. Such passages are quite effective because cooling oil circulates near the piston rings, where the need for heat reduction is greatest. Unfortunately, incorporating these passages into the crowns involves exotic foundry techniques and the manufacturing costs are high. Some pistons have their crowns separate from their skirts to facilitate formation of oil cooling passages. In fact, various two-piece piston designs are the norm for large pistons even though such designs carry penalties in terms of cost, weight and structural strength. Of course, weight and structural strength are especially critical in high performance engines.

FIG. 1 shows a typical prior art piston 10, inside of which is a wrist pin 12 defining a longitudinal chamber 14. Engine oil enters chamber 14 from a connecting rod (not shown) which has a bore through which the oil flows. Oil exits from chamber 14 through the wrist pin's passage 16 and enters passage 18 of the piston. From passage 18, oil goes to annular cavity 20 and through duct 22 into a central cavity 24. The oil accepts heat from the crown areas of piston 10 adjacent cavities 20 and 24. Oil drains from cavity 24 through egress 26. Also, since cavity 20 communicates to cavity 24, oil from cavity 20 ultimately drains through egress 26.

FIG. 2 shows another typical prior art piston 28 having a wrist pin 30 defining chamber 32. Oil exits chamber 32 through wrist pin passage 34, passes through piston passage 36 and then enters annular cavity 38. The oil accepts heat from the piston's crown 42 where annular cavity 38 is, and piston ring 40 is also cooled. Oil drains from cavity 38 through egresses 44, which open at locations of internal piston surface 46 not covered by journal boss 48.

SUMMARY OF THE INVENTION

My novel piston addresses the problems associated with two-piece piston construction and the high cost of casting coolant passages in pistons. My piston is unitary in that its crown and skirt are a single, integrated piece. My piston design allows the machining of a coolant passageway in the piston's crown and allows the drilling of ducts entering and exiting the coolant passageway. Machining or drilling the passageway and ducts is more economical than the exotic techniques needed to cast them.

Briefly, my piston has a crown integrally formed with a skirt, and an annular step is defined about the crown. An annular channel is machined in the step, and a ring belt covers and seals the channel so to form an annular coolant passageway. The piston has a series of passages by which coolant under pressure is conducted to the crown. Additionally, the crown has a coolant entry duct by which the coolant enters the annular passageway, and the crown's exit ducts carry the coolant from the annular channel to a cavity in the skirt. The ducts are drilled before the ring band is affixed to the crown.

DETAILED DESCRIPTION

Figure 3:
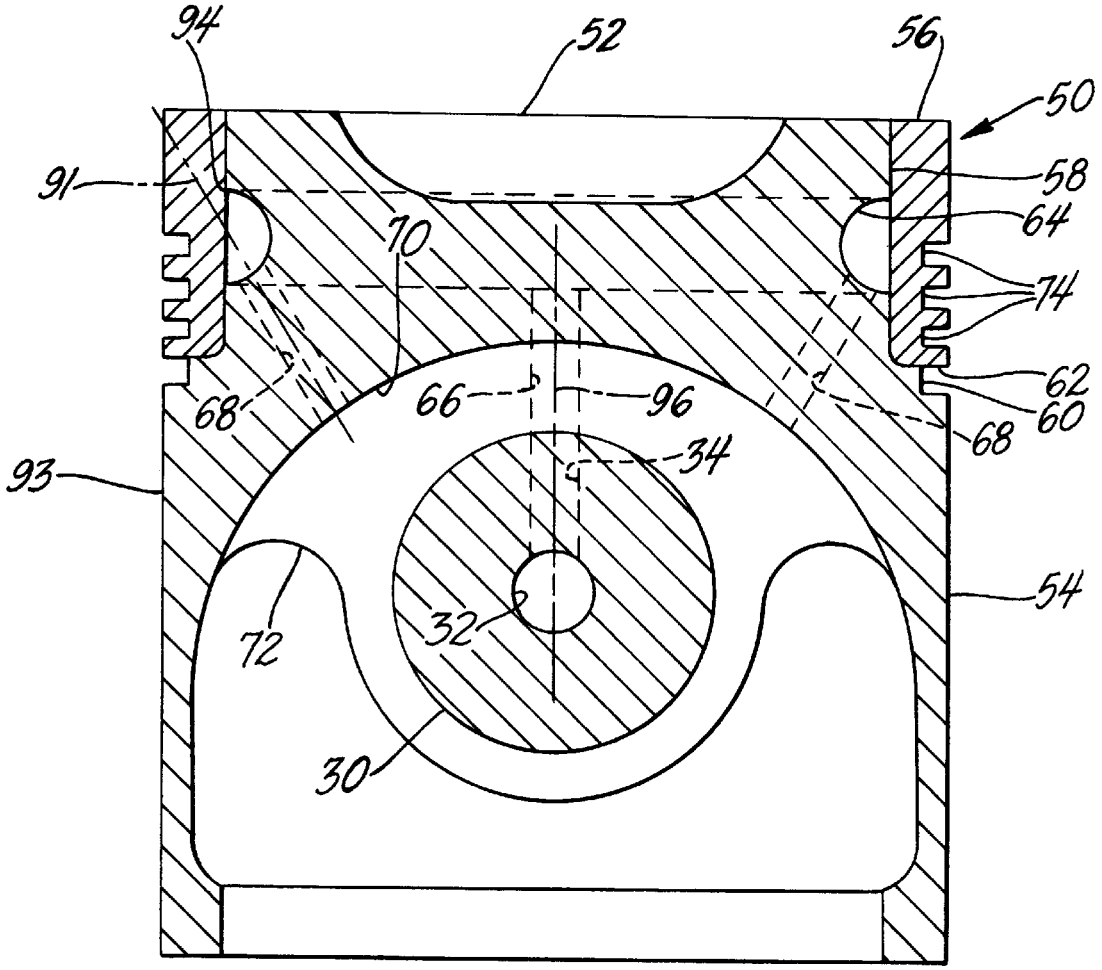
FIG. 3 is a sectional view of a first embodiment of my piston.

In FIG. 3 is a piston 50 comprised of a crown 52 integral with skirt 54 and a ring belt 56 surrounding the crown. Crown 52 defines a primary annular step 58 in which the ring belt is seated. The crown also defines a secondary annular step 60 adjacent the primary step. The inner diametrical surface of the ring belt preferably has a straight cylindrical configuration faced tightly against step 58. Belt 56 also typically has a generally flat rectangular cross section. The lower portion of belt 56 together with secondary step 60 define a groove 62 about crown 52. Typically, but not necessarily, groove 62 is cross-sectionally rectangular. Normally machined into primary step 58 is an annular channel 64, but channel 64 can be formed in crown 52 when piston 50 is cast.

Ring belt 56 sealingly covers channel 64 so that the channel and ring belt form an enclosed annular passageway for coolant. The advantage of this feature is that coolant in the passageway directly cools ring belt 56. The ring belt is permanently and facially attached to piston 50 by press fitting, shrink fitting, or threading along the circumferential mating surface between the belt and piston, or by welding or furnace brazing after assembly. Ring belt 56 defines a plurality of rectangular exterior ring grooves 74, as opposed to having such grooves in the body of the piston. Instead of being rectangular, grooves 74 can be Dykes ring grooves or keystone ring grooves, which are not rectangular. Optionally, the ring belt may be made of a higher strength material than piston 50 to strengthen ring grooves 74.

Figure 1:
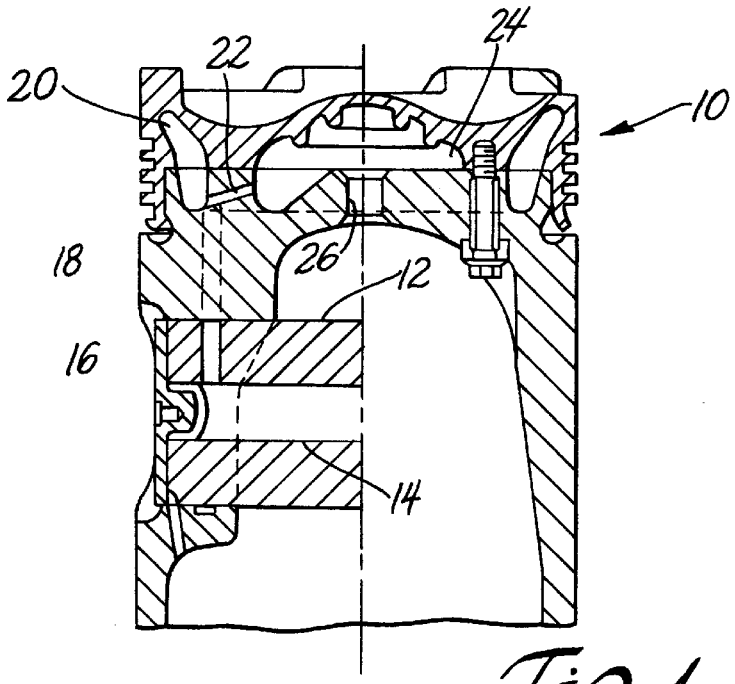
Fig. 1 PRIOR ART
FIGS. 1 and 2 are sectional views of prior art pistons.
Figure 2:
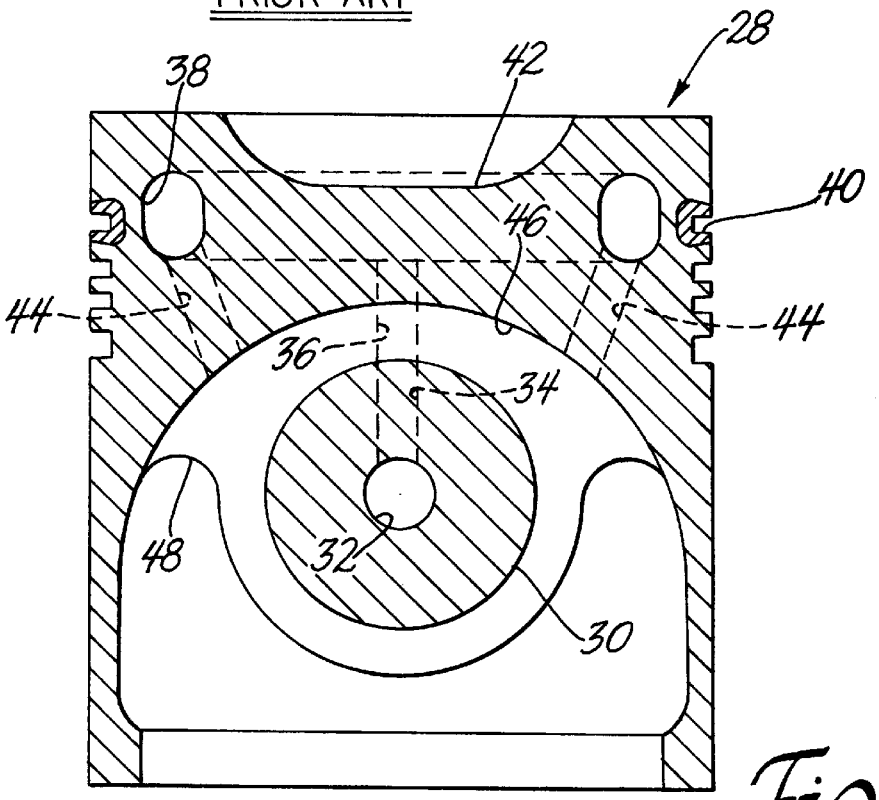

Still referring to FIG. 3, there is journalled within piston 50 a wrist pin 30 similar to the wrist pin in FIG. 2 having the same reference numeral. The pin 30 of FIG. 3 also defines chamber 32 and pin passage 34, which are similar to their counterparts in FIG. 2.

Before belt 56 is installed on crown 52, coolant entry duct 66 is bored so that duct 66 will connect channel 64 with passage 34. Coolant exit ducts 68 are also bored to connect channel 64 to internal piston surface 70 such that ducts 68 open at areas of surface 70 not covered by journal boss 72. Normally the entry and exit ducts will be bored or drilled from channel 64 downward and radially inward through surface 70. The center line 91 of duct 68 forms an acute angle with the straight cylindrical side 93 of piston 50. The acute angle will be such that a drill or bore bit will clear upper edge 94 of channel 64 as duct 68 is formed. Similarly, the center line 96 of duct 66 will be at an acute angle with side 93. In a manner of speaking, the entry and exit ducts are oriented along paths that clear the edges of channel 64.

Figure 4:
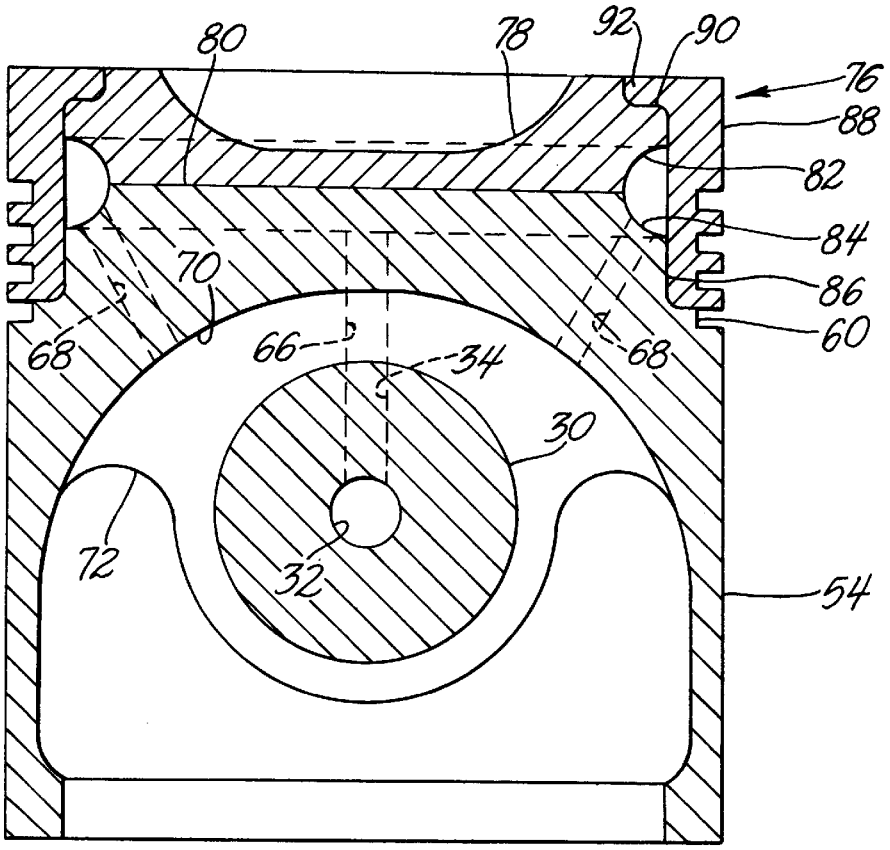
FIG. 4 is a sectional view of an alternate embodiment of my piston.

FIG. 4 shows an alternate embodiment 76 of my piston where the crown and ring band are modified and a ceramic biscuit is affixed to the crown. Features common to the embodiments in FIGS. 3 and 4 have the same reference numerals. In FIG. 4, a ceramic biscuit 78 bears facially upon the top of crown 80. The interface between biscuit 78 and crown 80 is planar in FIG. 4, but the interface can be curved in the case of a domed piston, or can be any suitable shape. Biscuit 78 defines an annular shallow channel 82, which complements shallow channel 84 of crown 80, the shallow channels together defining a deeper semicircular channel about the upper region of piston 76. Crown 80 has a step 86 which seats ring band 88 and biscuit 78 has a step 90 over which fits circular flange 92 of ring band 88. Flange 92 fixes biscuit 78 to crown 80 and biscuit 78 insulates the crown from combustion heat. Biscuit 78 can be replaced by another insulator, such as a stack having spaced sheet metal wafers sandwiched between nonmetallic wafers, a carbon biscuit, or a sintered biscuit.

Figure 5:
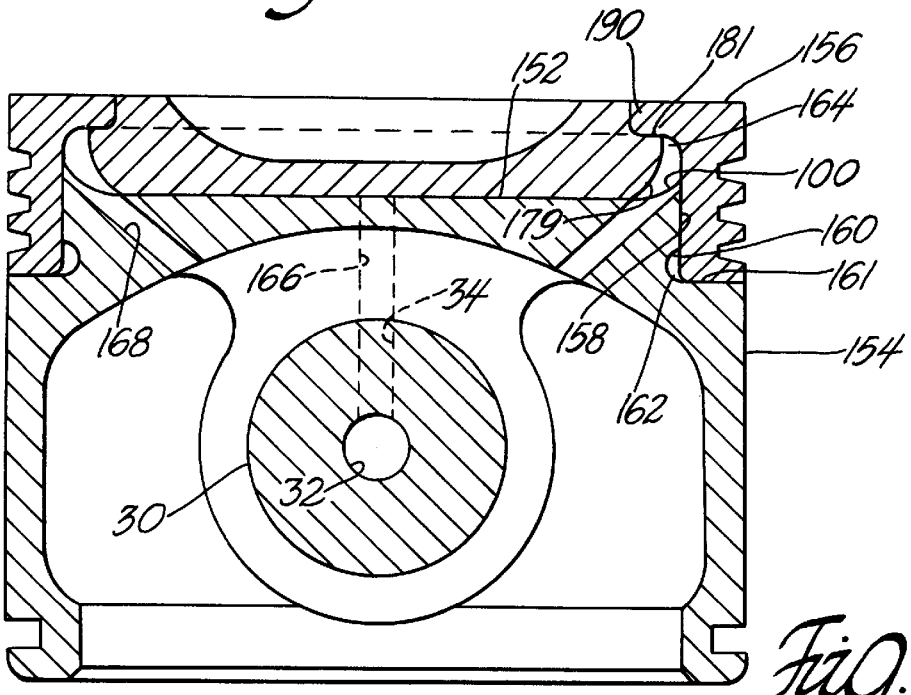
FIG. 5 is a sectional view of another alternate embodiment of my piston.

FIG. 5 shows a second alternate embodiment 150 of my piston, which has a preferred cross sectional shape of annular channel 164, an analog to annular channel 64 in FIG. 3. Coolant enters and exits channel 164 via entry duct 166 and exit ducts 168, which are analogous to ducts 66 and 68 in FIG. 3. Journalled within piston 150 is a wrist pin 30 similar to the like numbered wrist pin in FIG. 2. The pin 30 of FIG. 5 also defines chamber 32 and pin passage 34, which are similar to their counterparts in FIG. 2.

Piston 150 has a crown 152 integral with skirt 154 and a has ring belt 156 surrounding the crown. The crown defines an annular step 158 in which the ring belt is seated and also defines an annular groove 160 at shoulder 161 of the annular step. Annular groove 162 serves to provide a large fillet radius where desired for stress relief or clearance. The lower portion of belt 156 together with annular groove 162 define a closed channel resulting from groove 162 about crown 152.

Dished ceramic biscuit 178 faces upon the top of crown 152. The interface between biscuit 178 and crown 152 is flat in FIG. 5, but the interface can be curved in the case of a domed piston, or can be any suitable shape. Biscuit 178 has a convex portion 179 of its outer peripheral surface, and adjacent to surface 179 is annular biscuit step 181. Flange 190 of ring belt 156 fits in step 181 and the main body of ring belt 88 faces against step 158 of the crown so as to form enclosed annular channel 164.

Crown 152 defines a concave ridge 100 radially adjacent the biscuit's convex surface 179. Ridge 100, belt 156 and surface 179 together define the radially outwardly curved, crescent-like cross sectional shape of annular channel 164. This cross sectional shape is preferred since it allows greater surface contact between fluid in channel 164 than the FIG. 3 or 4 configurations do for their analogous channels for a given volume of coolant.

I wish it to be understood that I do not desire to be limited to the exact details of construction or method shown herein since obvious modifications will occur to those skilled in the relevant arts without departing from the spirit and scope of the following claims.

What is claimed is:

1. A piston comprising:

a crown of the piston;

an insulative body on the crown;

a skirt integral with the crown;

a cavity of the piston in the skirt;

means for conducting coolant to the crown;

a channel on the outside of the piston at the crown, sides of the channel being formed by a portion of the insulative body and a portion of the crown;

a first duct communicating the conducting means to the channel;

a second duct communicating the channel with the cavity;

a ring belt facially encircling the crown and the insulative body, the ring belt covering the channel so as to form an enclosed passageway;

means on the belt for holding the insulative body on the crown;

a primary annular step defined about the crown and integral therewith, the ring belt being set in the primary annular step, wherein an annular interface between the ring belt and the primary step is an only connection between the ring belt and the primary step; and a secondary annular step integral with the crown adjacent the primary annular step, wherein the secondary step and an edge of the belt define an annular groove about the piston.

2. The piston of claim 1 wherein the holding means is a circular flange on the belt.

3. The piston of claim 1 wherein:

the insulative body portion is a first shallow channel portion;

the crown portion is a second shallow channel portion; and the shallow channel portions are adjacent and together form the channel.

4. The piston of claim 1 wherein the holding means is a circular flange on the belt.

5. The piston of claim 1 wherein the insulative body is a round flat body defining a shallow basin.

6. A piston comprising:

a crown of the piston;

a skirt connected to the crown;

a cavity of the piston in the skirt;

means for conducting coolant to the crown;

a channel on the outside of the piston at the crown;

a first duct communicating the conducting means to the channel;

a second duct communicating the channel with the cavity;

a ring belt facially encircling the crown, the ring belt covering the channel so as to form an enclosed passageway an insulative body on the crown;

means on the belt for holding the body on the crown;

wherein sides of the channel are defined by a portion of the insulative body and a portion of the crown.

* * * * *